United States Patent [19]

Rist

[11] Patent Number: 4,745,959

[45] Date of Patent: May 24, 1988

[54] DRIVE MECHANISM FOR MOVABLE CLOTH AWNINGS

[76] Inventor: Wolfgang Rist, Weberstrasse 18, 6900 Heidelberg, Fed. Rep. of Germany

[21] Appl. No.: 942,279

[22] Filed: Dec. 16, 1986

[30] Foreign Application Priority Data

Dec. 24, 1985 [DE] Fed. Rep. of Germany ..... 3546093

[51] Int. Cl.[4] ..... E04F 10/06

[52] U.S. Cl. ..... 160/66; 160/22

[58] Field of Search ..... 160/66, 68, 70, 22, 160/310

[56] References Cited

U.S. PATENT DOCUMENTS

| | | | |
|---|---|---|---|
| 3,991,805 | 11/1976 | Clauss | 160/68 X |
| 4,615,371 | 10/1986 | Clauss | 160/22 |
| 4,624,084 | 11/1986 | Esposito | 160/310 X |
| 4,651,940 | 3/1987 | Nakamura | 160/310 X |
| 4,655,010 | 4/1987 | Arquati | 160/66 X |
| 4,657,059 | 4/1987 | Clauss | 160/66 X |

*Primary Examiner*—Ramon S. Britts
*Assistant Examiner*—David M. Purol
*Attorney, Agent, or Firm*—Kinzer, Plyer, Dorn, McEachran & Jambor

[57] ABSTRACT

The drive mechanism is used for movable cloth awnings employed as protective sunscreens and is mounted on a tubular roll-up shaft (1). In coaxial alignment with the roll-up shaft (1) is a drive shaft (2), and the two are mechanically coupled together. At each end there is a draw-cord plate (pulley) (7) in which the draw cord (9) is wound. Furthermore, at each side there is a guide track (11) with a configuration symmetrically matched to that of an open channel (14) on each side for a roller carriage (15), as well as a closed guide chamber (16) in which the draw cord (9) is forcibly retained. End support plates (3) engages medially with the profile of the guide track (11) and is provided with a mounting (4) which serves as a motor bearing, while the draw-cord plate (7) is rotatably mounted over the mounting (4) and the motor head (5).

5 Claims, 2 Drawing Sheets

DRIVE MECHANISM FOR MOVABLE CLOTH AWNINGS

Figure 1:
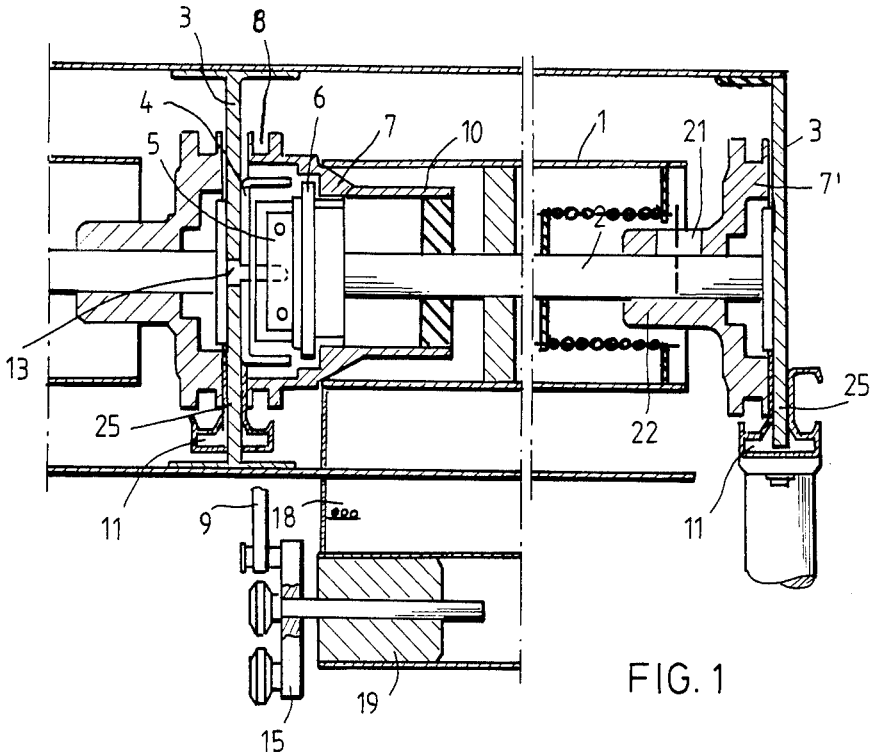

The invention concerns a drive mechanism for movable cloth awnings used as protective sunscreens, where the cloth covering is carried on a tubular roll-up shaft, which has a motor-driven drive-shaft with an attached plate [pulley] for a draw cord at each end, while the roll-up shaft and the drive shaft are mechanically coupled together, and which is provided with a guide track on each side in which rides a pull tab affixed to the leading edge of the cloth covering, while the draw cord, which is also attached to this pull tab, passes over a redirecting roller at the outer ends of the guide tracks and leads to the plate.

A drive mechanism of this general type is known (e.g., German Patent (OLS) No. 3,147,827), in which the roll-up shaft and the drive shaft are in coaxial alignment and the roll-up shaft is held under tension against the drive shaft by means of a spring. Drive is provided by a motor mounted within the shaft; this motor protrudes laterally, so that there is a projection beyond the draw-cord plate. This results in unfavorable combination possibilities for additional sections of such an awning, i.e., in side-by-side serial arrangements the space between the individual awnings are relatively great. An additional disadvantage is represented by the fact that the draw cord is often free-running.

Fundamental to the invention is a goal of designing a drive mechanism of this general type such that in the configuration of a profile for either individual or serial installation it is possible to arrive at a compact design with the awning guides and the roll-up concealed.

In keeping with the invention, this goal is realized in that the configuration of the guide tracks is symmetrically matched to that of a medial support plate, which has on each side an open channel for a roller carriage of the pull tab and a closed guide chamber for the draw cord, that the support plate on the motor side has a mounting serving as a motor bearing, and that the draw-cord plate on the motor side is rotatably mounted over the mounting and the motor head.

An advantageous embodiment has a motor-bearing ring connected with the mounting, upon which ring is mounted a tubular section of the draw-cord plate on the motor side.

It is also advantageous that the end support plate on the motor side be provided with a slot extending radially outward from about its mid-section.

It is further proposed that the guide chamber for the draw cord, which is positioned in the guide track, be provided with guide stays.

Furthermore, it is advantageous that the draw-cord plate on the motor side have, in the vicinity of the motor head, drilled holes and recesses for the accomplishment of adjustments and positional lockings.

It is likewise advantageous that the console have a plug-type connection, which is in approximately tangential orientation and is used as a guide into the medial profile chamber of the guide track.

Finally, it is advantageous that the draw-cord plate opposite the motor side be provided with an elongated bore running in the axial direction, which can be connected to the drive shaft.

The drive mechanism suitable for movable cloth awnings used as protective sunscreens, with interior or exterior installation, for pergolas, greenhouses, gently sloped shed skylights and glass cupolas, where the material does not unroll through free-fall but must be moved by means of a draw-rod, has the distinctive advantage that the drive mechanism is integrated in such a way that installation is possible with a gap of only two millimeters at the end support plate terminal. This holds true for both a one-sided and a two-sided drive mechanism powered by electrical motors within the tubes. As dictated by the configuration of the glass surface or the facade, or in keeping with the architectural design, any given radius can be covered, in either a clockwise or a counterclockwise direction, with such cloth awnings. With this mechanism, in which the roll-up shaft is in coaxial alignment with the drive shaft, there is only a minimal gap in the cloth covering between the awning guide in the end support plate and the cloth itself.

In the ensuing description, the invention is discussed in greater detail with reference to the appended drawings of embodiment examples.

Depicted are:

FIG. 1, a longitudinal section through such a drive mechanism, illustrated in foreshortened form.

Figure 2:
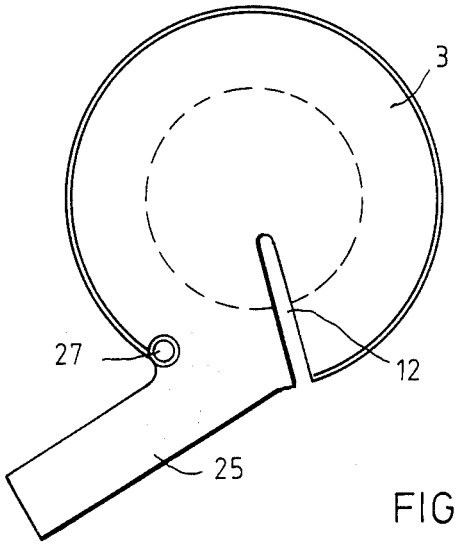

FIG. 2, the proposed end support plate with such a drive mechanism attached.

Figure 3:
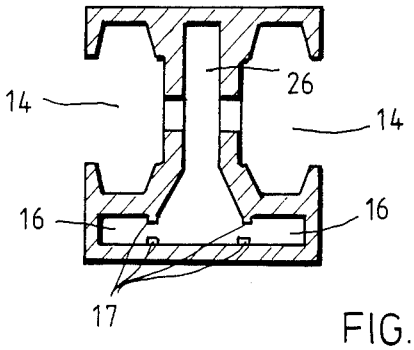

FIG. 3, a cross section through the profile of the guide track.

Figure 4:
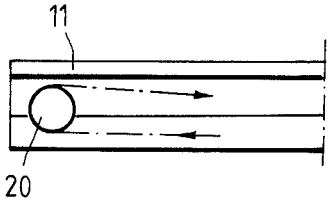

FIG. 4, the portion of the guide track at the point where the awning is redirected.

Figure 5:
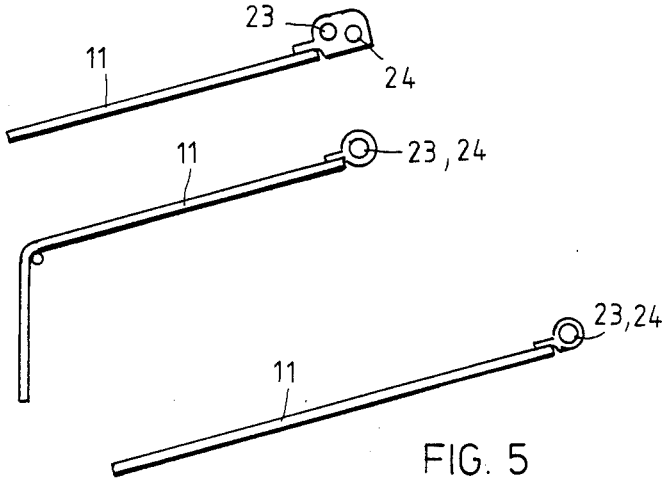

FIG. 5, various applicatory uses for such drive mechanisms in keeping with the invention.

In the embodiment example illustrated in FIG. 1 a tubular roll-up shaft (1) for the awning material is mounted in coaxial alignment with a drive shaft (2). The two shafts (1, 2) are mechanically coupled together by means of an unillustrated spring under pre-applied tension. At each end of the mechanism there is a plate-like console (3), while the console (3) on the motor side has an attached U-shaped mounting (4) which serves as a motor bearing. Affixed to this mounting (4) is the motor head (5) with an associated motor-bearing ring (6).

A draw-cord plate (7), which is rotatably mounted on the bearing ring (6), engages over the mounting (4) and the motor head (5). Immediately adjacent to the end support plate (3), this plate (7) has a guide groove (8) for a draw cord (9) and a cylindrical part (10) for better positioning on a motor tube to be provided and connected with the drive shaft (2). The draw-cord plate (7) has, in the vicinity of the motor head (5), drilled holes and recesses for the purposes of making minor adjustments against the embraced motor head. Positional lockings can also be made therewith.

By means of a plug-type connector (25) in the form of a flange depending from the end support plate (3) engages in a self-supporting manner within the medial profile chamber (26) of the symmetrically configured profile (11), which in each case forms the guide track. Thus the entire drive mechanism is enclosed in a supporting case. A roller (27) on one or both sides serves to redirect the band of cloth constituting the awning. In addition, the end support plate (3) has a slot (12) running radially outward, through which the power cable for the motor can be passed outward in such a way that the width of the end support plate (3) is simultaneously utilized for the lead-off of the motor cable. The slot (12) begins at about the level of the mid-axle.

The profile of the guide tracks (11) has at each side an open channel (14) for a roller carriage (15) as well as a closed guide chamber (16), in which the draw cord (9)

is stored. On the interior side of this guide chamber (16) there are guide stays (17), which insure a better tracking of the draw cord in the chamber (16).

The leading edge of the material (18) constituting the awning, which is wound on the roll-up shaft (1), is affixed to a pull tab (19), which is laterally supported by the roller carriage (15). Furthermore, the draw cord (9) passes from the draw-cord plate (7) over a redirection roller (20) on the end of the guide track (11) and is attached to the roller carriage (15).

The draw cord plate (7') on the side opposite the motor is of a design different from that of the plate (7) on the motor side. It has a guide groove (8) and a hub (22) for attachment to the shaft (2).

In the vicinity of its hub (22) directed toward the shaft (2), this draw-cord plate (7') has an elongated bore (21), which facilitates the ready insertion of the axles into the bearings.

The drive mechanism of the invention is suitable for various drive systems, as exemplified, e.g., in FIG. 5. Here the first embodiment example shows two separated axles, one axle (23) for the sheet of cloth and one axle (24) for the draw cord. In the case of the next embodiment example, the two rollers are shown in one coaxial arrangement, while the guide track (11) initially runs obliquely and then at a bend steeply downward. With the third embodiment form, the two axles are also in coaxial arrangement and the guide track (11) runs uniformly downward in an oblique direction. In all of these instances it is possible to incorporate such widely varying drive systems as tandem drive with motor roller and spring roller, tandem drive with two motor rollers or a drive such as that described in connection with the embodiment example depicted in FIG. 1.

I claim:

1. Drive mechanism in combination with movable cloth awnings wherein the cloth awning is carried on a tubular roll-up shaft (1) coupled to a motor driven drive shaft (2) with a pulley (7,7') for a draw-cord at each end of the drive shaft, the leading edge of the cloth awning being attached to a pull tab (19), each pulley being provided with a draw-cord guide groove (8) in which rides a draw-cord (9), the draw-cord also passing over a redirecting roller at the outer end of a separate guide track member and leading back to the draw-cord pulley, characterized in that: there are guide track members (11) for a roller carriage (15), each guide track being supported by end support plates (3) and having an open groove (14) opposed to a related guide channel (8), the pull tab (19) being attached to the roller carriage, and each guide track member having a guide chamber (16) for storing the pull cord; further that there is a motor head (5) at one end of the roll-up shaft with the end support plates (3) on the motor head side having a mounting (4) which serves as motor bearing, and that the draw-cord pulley (7) on the motor head side is rotatably mounted over both the mounting (4) and the motor head (5) and wherein each end support plate (3) has plug-type connection (25) in the form of a depending flange received within a medial chamber (26) of the related guide track member (11).

2. Drive mechanism according to claim 1, characterized by the fact that a motor-bearing ring (6) connected with the mounting (4) is provided on top of the motor head (5), upon which ring is mounted a tubular section (10) of the draw-cord pulley (7) on the motor head side.

3. Drive mechanism according to claim 2, characterized by the fact that the end support plate (3) on the motor side has a power cable slot (12) extending radially outward from about its mid-section.

4. Drive mechanism according to claim 1, characterized by the fact that the draw cord pulley (3) on the motor head side has, in the vicinity of the motor head (5), drilled holes and recesses for the accomplishment of adjustments and positional lockings.

5. Drive mechanism according to claim 1, characterized by the fact that the guide chamber (16) for the draw cord (9), which is positioned in the guide track member (11), has guide stays (17).

* * * * *